US006070046A

United States Patent [19]

Maeyama

[11] Patent Number: 6,070,046

[45] Date of Patent: May 30, 2000

[54] IMAGE HEATING FILM HAVING REINFORCING MEMBER AND IMAGE HEATING APPARATUS HAVING SAME

[75] Inventor: Ryuichirou Maeyama, Yokohama, Japan

[73] Assignee: Canon Kabushiki Kaisha, Tokyo, Japan

[21] Appl. No.: 08/921,542

[22] Filed: Sep. 2, 1997

[30] Foreign Application Priority Data

Sep. 2, 1996 [JP] Japan ..... 8-231908

[51] Int. Cl.[7] ..... G03G 15/20

[52] U.S. Cl. ..... 399/328; 399/329

[58] Field of Search ..... 399/328, 69, 122, 399/320, 330, 333, 336; 347/156; 219/216, 600, 619

[56] References Cited

U.S. PATENT DOCUMENTS 5,552,582 9/1996 Abe et al. ..... 219/619

5,745,833 4/1998 Abe et al. ..... 399/330

5,881,349 3/1999 Nanataki et al. ..... 399/328

FOREIGN PATENT DOCUMENTS 62-150371 7/1987 Japan .

5-9027 2/1993 Japan .

*Primary Examiner*—Quana Grainger

*Attorney, Agent, or Firm*—Fitzpatrick, Cella, Harper & Scinto

[57] ABSTRACT

An image heating apparatus includes a film; magnetic flux generating member for generating a magnetic flux; wherein the magnetic flux generated by the magnetic flux generating member generates an eddy current which in turn generates heat in the film to heat an image on a recording material; and wherein wire rods of ferromagnetic member are dispersed in the film.

25 Claims, 7 Drawing Sheets

IMAGE HEATING FILM HAVING REINFORCING MEMBER AND IMAGE HEATING APPARATUS HAVING SAME

FIELD OF THE INVENTION AND RELATED ART

The present invention relates to an image heating device usable with an image forming apparatus such as a copying machine or a printer, more particularly to an image heating device which heats a material to be heated by heat produced by eddy current caused in an electroconductive member using electromagnetic induction, and an image forming apparatus using the same as an image fixing device.

In an image forming apparatus such as a copying machine, a printer or a facsimile machine, a toner image is formed through a production image process such as electrophotographic type process, an electrostatic recording type process or magnetic recording type process and is transferred onto a recording material (transfer material, photosensitive paper, electrostatic recording paper, printing paper or another sheet-like material), and then is heated and fixed thereon.

As for the fixing device which heats and fixes the toner image, a contact heating type using a heat roller has been widely used.

An electromagnetic induction heating type fixing device has been proposed as disclosed in Japanese Patent Application Publication No. HEI-5-9027 wherein eddy currents are generated in a fixing roller by magnetic flux so that joule heat is produced. This has an advantage over a type using a halogen lamp since the heat generation position can be closer to the toner image to be heated.

The assignee of this application has proposed in Application Ser. No. 08/551646 an electromagnetic induction heating type fixing device wherein the eddy current is generated in a film to generate joule heat.

When heat generation is through a film, the temperature rise is quick since the film has a smaller thermal capacity then a fixing roller, but the strength, durability and the service life of the film is poorer since the thickness of the film is small. Particularly, when the film has an elastic layer, the elastic layer is relatively easily deteriorated, so that problems are more significant.

SUMMARY OF THE INVENTION

Accordingly, it is a principal object of the present invention to provide an image heating device wherein the strength of the film which produces heat by magnetic flux generating means is improved.

It is another object of the present invention to provide an image heating device wherein wire rods of ferromagnetic member are dispersed in a film producing heat by magnetic flux generating means.

It is a further object of the present invention to provide an image heating device wherein fibers of ferromagnetic member are dispersed in a film producing heat by magnetic flux generating means.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Referring to the accompanying drawings, the embodiments of the present invention will be described.

Figure 1:
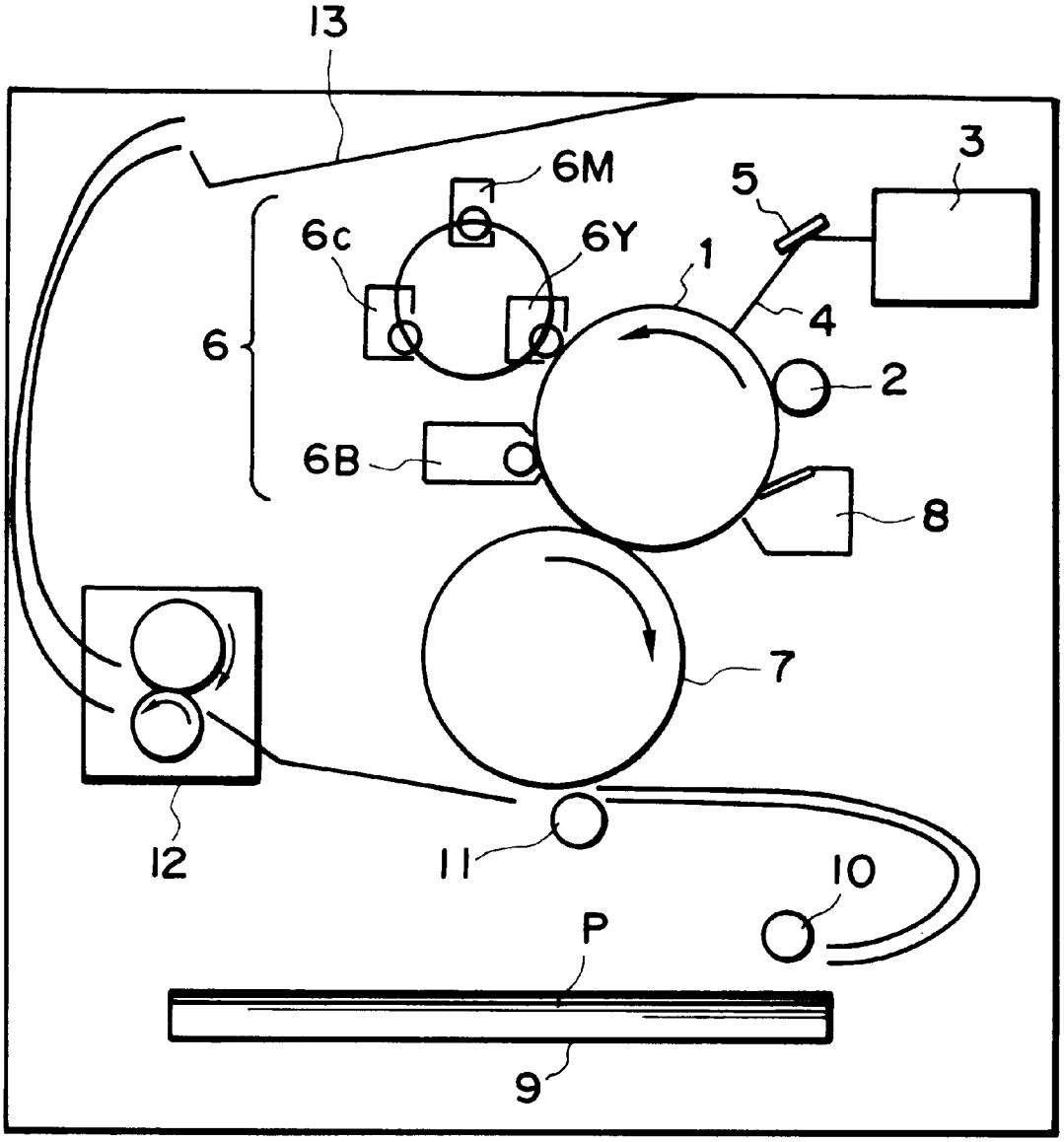
FIG. 1 is a schematic illustration of a printer.
Figure 2:
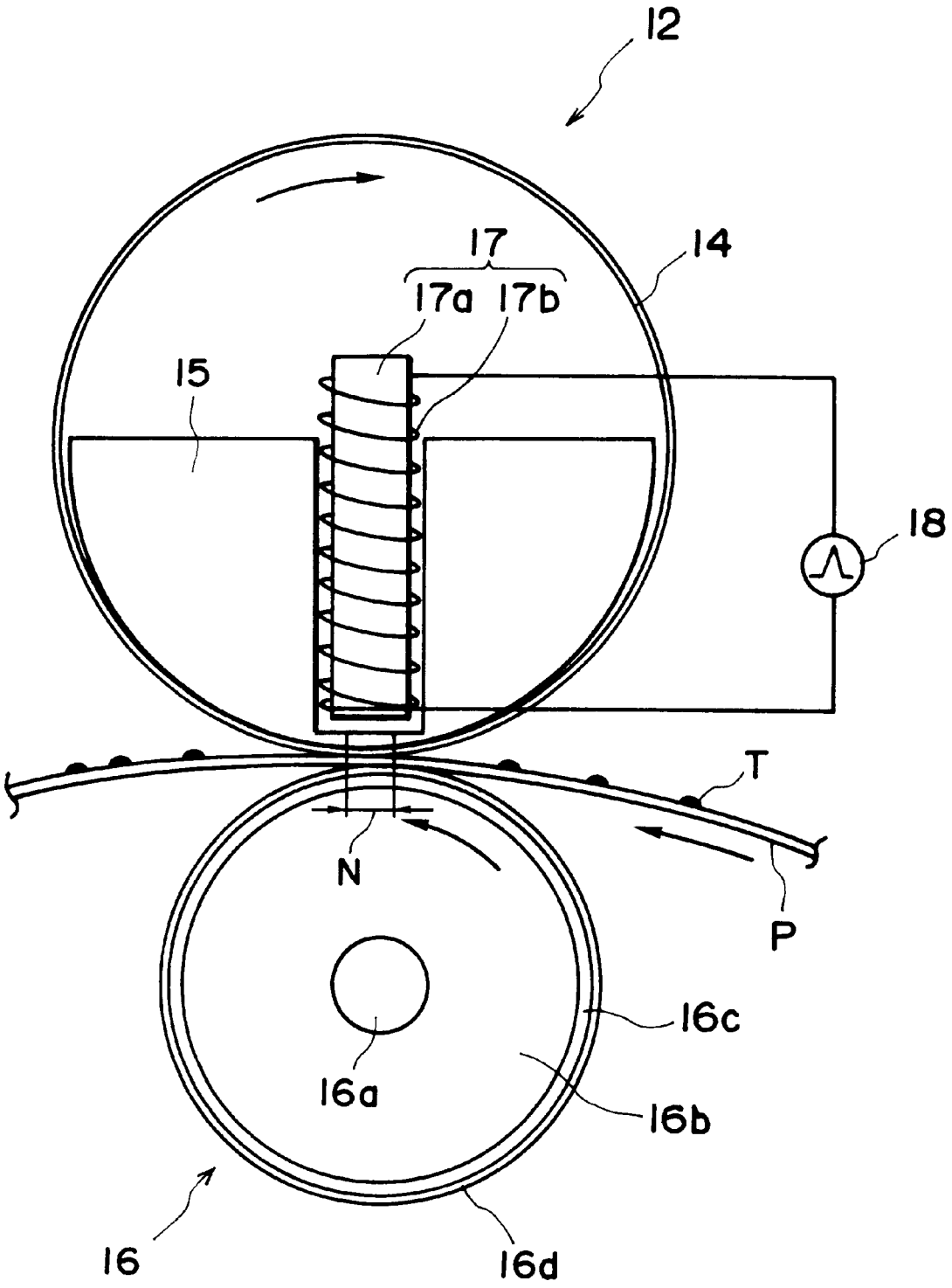
FIG. 2 is a schematic illustration of a fixing device.
Figure 3:
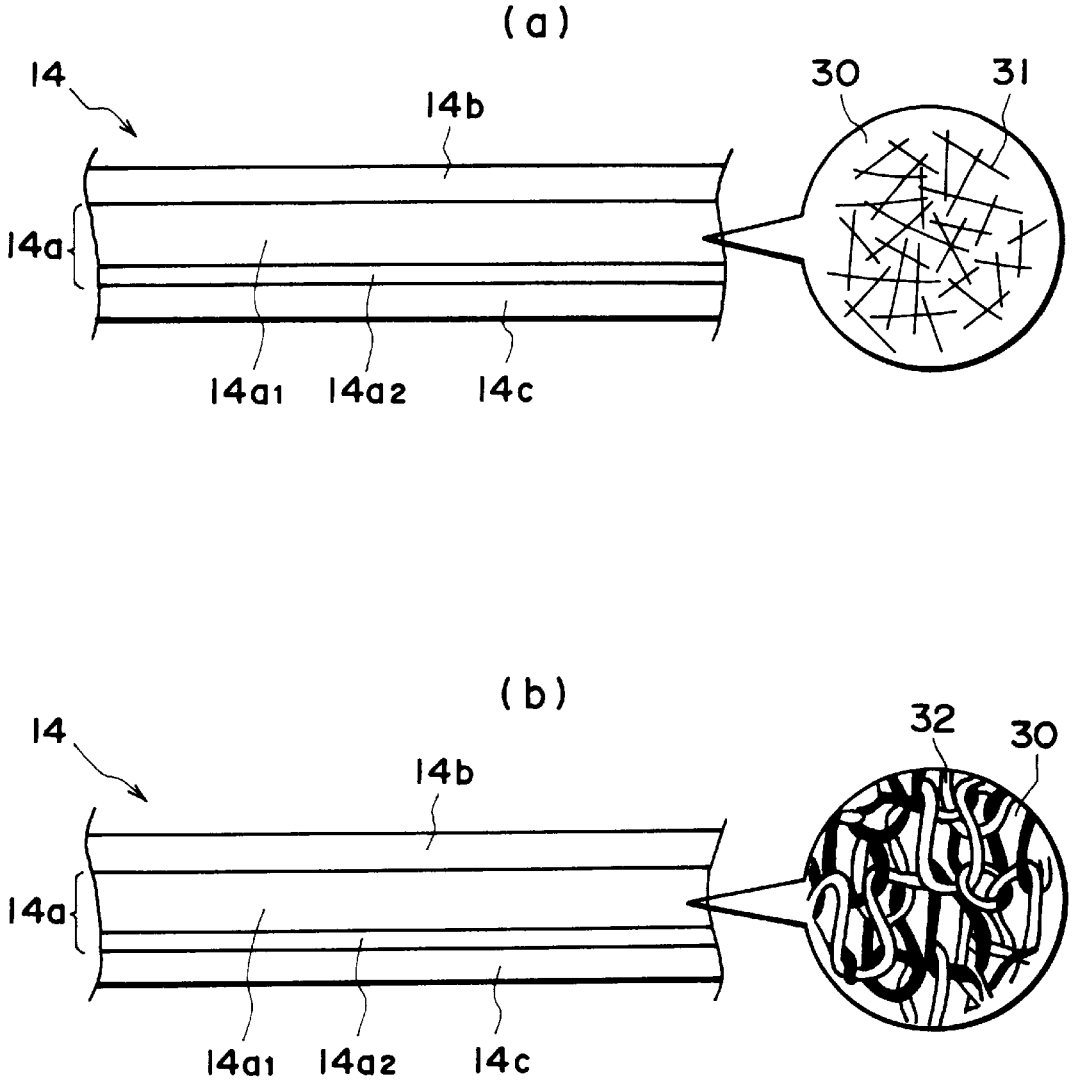
FIG. 3 is an illustration of a fixing belt.
Figure 4:
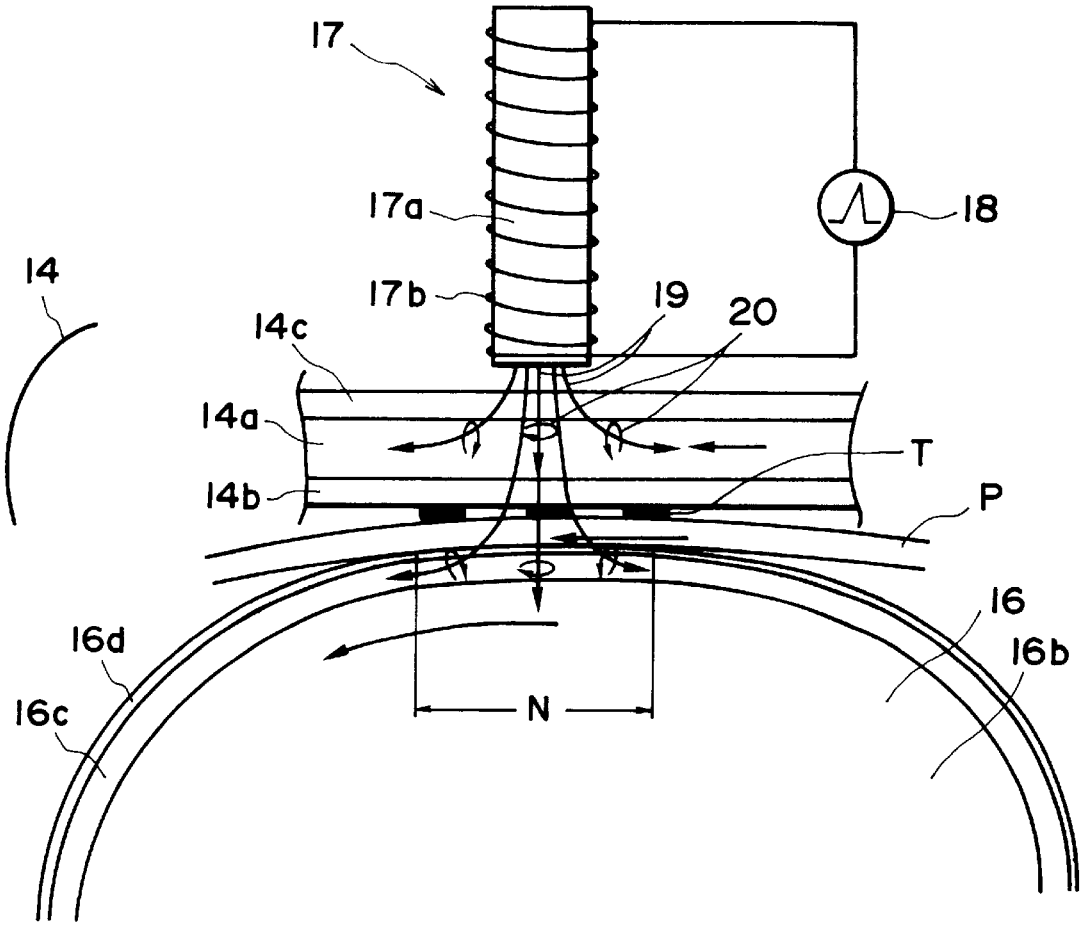
FIG. 4 is an illustration of heating principle in the fixing device.

Referring to FIG. 1 to FIG. 4, the example of the image forming apparatus is a laser beam printer wherein a heating apparatus of the present invention is used as a fixing device. FIG. 1 is a schematic illustration showing an entirety of the printer; FIG. 2 is a schematic illustration of the fixing device; FIG. 3 is an illustration of a belt; and FIG. 4 is an illustration of a heating principle.

First, the description will be made as to a general arrangement of the image forming apparatus, and then as to the fixing device.

General Arrangement of Image Forming Apparatus

The image forming apparatus of this embodiment has a photosensitive drum 1 in the form of an organic photosensitive member or an amorphous silicon photosensitive member, as shown in FIG. 1, the photosensitive drum 1 being rotatable at a predetermined peripheral speed (process speed) in the counterclockwise direction. The peripheral surface of the photosensitive drum 1 is uniformly charged to a predetermined polarity and potential by a charging roller 2. The thus charged surface of the photosensitive member 1 is exposed to and scanned by a laser beam 4 having an intensity modulated (on/off) in accordance with time series electric digital pixel signal from an image signal generating apparatus such as an image reading apparatus, a computer or the like, so that electrostatic latent image thereof is formed. The laser beam is projected from a laser optical means 3.

An unshown laser beam scanner including a laser diode, polygonal mirror or the like. Designated by 5 is a laser beam reflection mirror and deflects the emitted laser beam 4 from the laser optical means 3 to the photosensitive drum 1.

Designated by 6 is a developing means comprising a black toner developing device 6B a color development device which comprises a yellow toner developing device 6Y, a magenta toner developing device 6M, a cyan toner developing device 6C, which are exchangeably operable.

Designated by 7 is an intermediary transfer drum. The intermediary drum is contacted to or disposed close to the photosensitive drum 1 and is rotated in the same peripheral direction and substantially at the same speed.

An electrostatic latent image formation on the photosensitive drum for a color separated image, a development of the electrostatic latent image and transfer of the developed image onto the intermediary transfer drum, is carried out, and the same is repeated for the remaining color separated images, so that superposed transferred images constituting a full color toner image is formed on the intermediary transfer drum 7. The resultant image is a mirror image of the intended image.

Designated by 8 is a cleaner for cleaning the surface of the photosensitive drum 1 after toner image transfer onto the intermediary transfer drum 7.

To the intermediary transfer drum 7, a transfer material P as a recording material is fed out of a sheet feeding cassette 9 by a sheet feeding roller 10 one by one, and the mirror full-color toner image is transferred onto the transfer material P by a transfer roller 11 so that full-color toner image is formed on the transfer material P. The transfer roller 11 supplies a charge of an opposite polarity from the toner to the rear surface of the transfer material P to transfer the toner image onto the transfer material P from the intermediary transfer drum 7.

The transfer material P now having the full-color toner image is separated from the intermediary transfer drum 7 and is fed to a fixing device 12, where it is subjected to a heating and fixing for the toner image, and then the transfer material P is discharged onto a sheet discharge tray 13.

Structure of Fixing Device

Referring to FIGS. 2 to 4, the description will be made as to a structure of a fixing device (heating apparatus) 12 for fixing the transferred toner image.

FIG. 2 is a schematic illustration of a fixing device 12, which comprises film-like belt having an electroconductive layer (heat generation layer), a pressing member having an electroconductive layer (heat generation layer) and an alternating magnetic field generating means for heat generation by generation of eddy current using a magnetic field in the electroconductive layer, wherein a material to be heated is passed through a nip formed between the belt and the pressing member and is heated.

In FIG. 2, designated by 14 is a fixing belt having an electroconductive layer, and is a cylindrical (endless belt type) belt in this embodiment, as will be described in detail hereinafter. The cylindrical belt 14 is loosely extended around a semicircular belt guide 15.

Designated by 16 is a pressing roller as a pressing member including an electroconductive layer, as will be described in detail hereinafter.

Designated by N is a nip (fixing nip) formed by a lower surface of the belt guide 15 and the pressing roller 16 with the belt 14 therebetween.

Designated by 17 is an alternating magnetic field generating means (magnetic flux generating means), and comprises a high magnetic permeability core 7*a* and an excitation coil 7*b* therearound. It is supported on a belt guide 15 at the central portion so that bottom end thereof is close to the fixing nip N. Designated by 18 is a magnetic circuit (excitation circuit) connected to the coil 17*b*.

The pressing roller 16 is rotated in the counterclockwise direction as indicated by the arrow in FIG. 2. With the rotation of the pressing roller 16, the cylindrical fixing belt 14 is driven around the belt guide 15 in the clockwise direction indicated by the frictional force relative to the pressing roller 16, while the inner surface is in close sliding contact with the lower surface of the guide 15 at the fixing nip N. The belt guide 15 functions to stabilize the pressing to the fixing nip N and the movement of the fixing belt 14.

The transfer material P (material to be heated) is introduced into the nip formed between the fixing belt 14 and the pressing roller 16, so that transfer material P is passed through the fixing nip N together with and in contact with the fixing belt 14.

FIG. 3 schematically shows a structure of the layer of the fixing belt 14. Both sides of the electroconductive layer 14*a* of the fixing belt 14 are coated with the heat resistive layers 14*b*, 14*c*. The electroconductive layer 14*a* comprises a core material $\mathbf{14}a_2$ and an elastic member $\mathbf{14}a_1$ reinforced with wire rods or fibers of ferromagnetic material. The ferromagnetic material may be of metal such as nickel, iron, stainless steel. Other usable examples include steel wool fiber, aluminum metal steel wool or carbon fibers plated with ferromagnetic material. Artificial fiber or heat resistive fiber plated with the material is usable.

The core material $\mathbf{14}a_2$ is a metal layer of nickel or the like, and the elastic member is an elastic layer of silicone rubber, fluorine rubber or another heat resistive rubber, and the rubber material contains the wire rods or the fibers as the reinforcing material dispersed therein. FIG. 3, (a) shows an example wherein the wire rods 31 are dispersed in the rubber 30, and the wire rods constitute net-like structure from the viewpoint of producing eddy current. FIG. 3, (b) shows an example wherein the fibers 32 are dispersed in the rubber 30.

It is preferable that wire diameter of the wire rods is approx. 1 $\mu$m to 1 mm for example, and that solid conversion weight ratio relative to the elastic layer is not less than 2.5 wt. %. Fiber may be in the form of a stack of meshed fibers. The fiber length is any. However, it is preferable that electrical connection is established between fibers.

This is because then the generation of the eddy current over wide range results in large heating value. The gap in the electroconductive layer is filled with a heat resistive material having a high parting property, such as silicone resin material, fluorine resin material, silicone rubber, fluorine rubber or the like. They function as a reinforcing member as in the conveyer belt.

The heat resistive layer 14*b* coating the outer surface side of the electroconductive layer 14*a* is of heat resistive material having a high parting property, such as silicone resin material, fluorine resin material, silicone rubber, fluorine rubber or the like. The heat resistive layer 14*c* coating the inner surface side of the electroconductive layer 14*a* is a heat resistive resin material layer of fluorine resin material, polyimide resin material, polyamide resin material, PPS, PEEK resin material, liquid crystal polymer, phenolic resin or the like.

The pressing roller 16 comprises a core metal 16*a*, an elastic layer 16*b*, therearound, of heat resistive material such as a silicone rubber, fluorine rubber or the like, an electroconductive layer (heat generation layer) 16*c* thereon for generating the eddy current, and a surface parting resin material layer 16*d* of heat-resistive material such as a fluorine resin material, silicone resin material or the like.

The high magnetic permeability core 17*a* of the alternating magnetic field generating means 17 is of a material usable for a core of a transformer such as ferrite or permalloy, and ferrite is preferable since the loss is low even when the frequency is 100 KHz or higher. The excitation circuit 18 generates a high frequency of 20 KHz to 500 KHz using a switching voltage source.

By generating the high frequency in the coil 17*b* of the alternating magnetic field generating means 17 by the excitation circuit 18, a magnetic field enters the electroconductive layer 14*a* of the fixing belt 14 and the electroconductive layer 16*c* of the pressing roller 16 at a fixing nip N, so that eddy currents are generated in the electroconductive layers 14*a* and 16*c*, by which the heat generation occurs there to heat the fixing nip N. Thus, the unfixed toner image is heated and fixed on the transfer material P, while the transfer material P is passed through the fixing nip N between the fixing belt 14 and the pressing roller 16.

By such a magnetic induction heat-fixing operation with this structure, one heating element is enough to heat both sides of the transfer material P, and the thermal capacity is small, and in addition, the heat conduction occurs quickly. Therefore, the rising time or start-up time of the fixing apparatus can be significantly reduced.

Referring to FIG. 4, the description will be made as to the heating principle in the fixing nip N. The magnetic flux generated by the current applied to the coil 17*b* by the excitation circuit 18, is guided by the high magnetic permeability core 17*a* and generates the magnetic flux 19 and the eddy currents 20 in the electroconductive layer 14*a* of the fixing belt 14 at the fixing nip N. By the eddy current 20 and the specific resistance of the electroconductive layer 14*a* , the heat is generated.

The elastic layer 14*a* , generates heat by the eddy current generated in the wire rods or the fibers, and the core member $\mathbf{14}a_2$ generates heat by the eddy currents generated in the metal layer. In the neighborhood of the surface of the pressing roller 16, the eddy current is generated in the electroconductive layer 16*c* by the magnetic flux entering the electroconductive layer 16*c*, thus heating the back side of the transfer material P. Thus, the heat is supplied to the front and back sides of the transfer material P to fuse the toner T, which is then cooled into a permanent fixed image.

The material of the core member $\mathbf{14}a_2$ of the electroconductive layer 14*a* of the fixing belt 14, is preferably metal such as nickel, iron, magnetic stainless steel or the like, which has high magnetic flux absorbing performance. The thickness of the electroconductive layer 14*a* is preferably not more than layer thickness 200 $\mu$m. Further preferably, it does not exceed the skin depth expressed by the following equation. If it exceeds the skin depth, the amount of the energy to be supply to the pressing roller 16 is small.

The skin depth σ (m) is expressed with the frequency f (Hz) of the excitation circuit, magnetic permeability $\mu$ and the specific resistance ρ (Ω/m), as follows:

$$\sigma=503\times(\rho/f\mu)^{1/12}$$

It indicates the depth of absorption of the electromagnetic radiation used in the electromagnetic induction, and the strength of the electromagnetic radiation is not more than 11*e* at a portion deeper than that. Therefore, most of the energy is absorbed by that depth.

On the other hand, if the layer thickness of the electroconductive layer 14*a* exceeds 200 $\mu$m, the inherent hardens of the metal becomes significant to such an extent that it is difficult to use it as a belt. Additionally, the thermal capacity becomes so large that device is heated up from a room temperature to a fixing temperature in several seconds.

The heat resistive layers 14*b* at the both outer sides of the fixing belt 14 are of the material having a high parting property and having a thickness of 5 $\mu$m to not less than 25 $\mu$m. If it is 25 $\mu$m or larger, the heat conduction is poor, and the strength of the coating is poor. Furthermore, the number of manufacturing steps increases, and the required amount of the material is large. On the other hand, if is 5 $\mu$m or smaller, the non-uniformity of the coating would result in the local portions having low parting property, and the durability is poor.

The thickness of the heat resistive resin material layer 14*c* inside the fixing belt 14 is preferably not less than 10 $\mu$m, and not more than 1 mm. If it is less than 10 $\mu$m, the heat insulation effect is not enough, and the durability is not enough, either. On the other hand, if it exceeds 1 mm, the electroconductive layer 14*a* becomes so remote from the high magnetic permeability core 17*a* that magnetic flux is not sufficiently absorbed by the electroconductive layer 14*a*.

The material of the electroconductive layer 16*c* as the heat generation layer of the pressing roller 16 is preferably nickel, iron, stainless steel or the like, which has a high magnetic permeability and low electric resistance. When the use is made with the belt including a core member and an electroconductive layer having an elastic material reinforced with wire rods and fibers of ferromagnetic member, the thickness of the pressing roller 16 is preferably not more than 100 $\mu$m, and is preferably larger than the thickness of the skin as with the fixing belt 14 in order to provide the elasticity of the pressing roller 16.

It is also preferable that sum of the thickness of the electroconductive layer 14*a* of the fixing belt 14 and the thickness of the electroconductive layer 16*c* of the pressing roller 16 is larger than the skin thickness, and the thickness of the fixing belt 14 is not more than the thickness of the skin. This will be understood from the above-described feature of the absorption of the above-described electromagnetic radiation. The actual thicknesses of the electroconductive layers 14*a* , 16*c* are determined on the basis of the required heating value, the frequency of the excitation circuit 18 and the resistance and the magnetic permeability of the electroconductive layer. It is not always necessary that materials of the electroconductive layers 14*a* , 16*c* are the same.

Thus, according to this embodiment, the belt in the form of a film contains the wire rods or fibers of ferromagnetic member dispersed therein, so that belt is reinforced, and therefore, the strength of the belt is improved. Particularly in this embodiment, the wire rods or the fibers are dispersed in the elastic layer, so that strength of the elastic layer, which is relatively easily deteriorated, is enhanced.

In this embodiment, the eddy currents are generated in the wire rods and fibers which are reinforcing members, so that elastic layer of the belt also generates heat, and therefore, the heat efficiency is enhanced.

In this embodiment, the heat is generated directly from the belt 14 including the electroconductive layer having the elastic material reinforced with the wire rods and fibers of ferromagnetic member on the core member close to the material to be heated P, and the heat is transferred to the material to be heated P through the thin heat resistive layer 14*b*, and additionally, the resin material layer 14*c* is provided as a heat insulation layer to prevent the heat generated in the metal belt 14 from directing toward the inside of the belt. Therefore, the efficiency is significantly improved over a conventional heating and fixing apparatus using a heat roller or another belt.

The description has been made as to an endless cylindrical belt 14, but the fixing belt 14 may be in the form of a winding type non-endless belt. The same applies to the electroconductive layer 16*c* of the pressing roller 16.

Experiment results of image formation using the fixing device 12 of embodiment will be described.

Experiment 1

The electroconductive layer 14*a* of the fixing belt 14 comprised a rubber having an inner diameter of 24 mm and a length of 230 mm and nickel fibers (diameter: 1 $\mu$m) in the form of a nickel mesh (solid conversion ratio of 50%), and was press-molded into a cylinder having a layer thickness of 50 $\mu$m.

The pressing roller 16 comprised a core metal 16*a* having an outer diameter of 16 mm, a silicone rubber layer thereon as the heat resistive elastic layer 16*b* having a layer thickness of 2 mm, surface length of 230 mm, a nickel layer thereon as the electroconductive layer 16*c* having a layer thickness of 50 $\mu$m, and, a coating layer of PFA/PTFE material thereon as the heat resistive resin material layer 16*d*.

The ferrite core 17*a* comprised seven ferrite cores each having a length of 30 mm, a height of 10 mm and a width of 4 mm which are arranged on a line into a length of 210 mm, and a coil 17*b* was wound therearound 15 turns.

The coil 17*b* was supplied with a DC voltage of 140 V, 250 KHz with 50% ON-duty.

When the apparatus was operated, the temperature of the fixing belt 14 reached 150° C. in approx. 15 sec. and the temperature of the surface of the pressing roller 16 was 100° C. at that time. The temperature was enough to properly fix color toner images.

Experiment 2

This Experiment was the same as Experiment 1 with the exception that used toner was polymerized toner. The temperature of the fixing belt 14 reached 150° C. in approx. 15 sec, and at that time, the temperature of the surface of the pressing roller 16 was 100° C. The temperature was enough to properly fix the color toner image.

The toner was prepared as follows:

Aqueous solution 450 g of 0.1M—$Na_3Po_4$ is supplied into an ion exchange water (710 g), and is heated up to 60° C., and then is stirred at 13000 rpm in a mixer. An aqueous solution 68 g of 1.0M—Ca $C_{12}$ is gradually added thereto to provide a water base solvent including $Ca_3(Po_4)_2$. On the other hand, the following is prepared:

Styrene: 166 g

N-butyl acrylate: 34 g

Copper phthalocyanine pigment: 15 g

Di-tertiary metal butyl salicylate chemical compound: 3 g

Saturated polyester: 10 g (acid number 11; peak molecular weight: 8500)

Mono-ester wax: 140 g (Mw 500, Mn 400, viscosity: 6.5 m Pas, SP value: 8–6)

They are heated to 60° C., and are uniformly dissolved and dispersed at 12000 rpm using a mixer. 10 g of polymerization initiator, 2,2'-azobis-2,2'-dimethylvaleronitrile was dissolved thereto to provide a polymerization monomer composition. The polymerization monomer composition is supplied into a water base solvent, and the mixture is stirred for 20 minutes at 10000 rpm by a mixer at 60° C. and under $N_2$ ambience, thus providing particles of polymerization property single amount member composition. Then, it is heated up to 80° C. while stirring it by a stirring paddle, and the reaction is effected for 10 hours. After the polyreaction, it is cooled, and hydrochloride is added to dissolve the calcium phosphate, and is filtered, rinsed with water and dried, so that polymerized particles are produced.

To 100 parts by weight of the thus produced particles, 2.0 parts by weight of hydrophobic titanium oxide having a specific surface area of 100 $m^2/g$ are added to provide toner having an average particle size of 6.2 $\mu$m.

To 7 parts by weight of the toner thus produced. 93 parts by weight of silicone coating coated chlorite carrier having a particle size of 35 $\mu$m are mixed, and the mixture is used.

When the polymerized toner is used, the seeping of the wax is quick since the toner is heated before and after the nip of the fixing belt as well as the nip. Therefore, the parting property and the fixing property are very good.

Recently, the natural resource saving is important, and the demand toward the recording device capable of forming images on both sides of a recording material, is increasing. The following embodiment is directed to such a duplex image forming apparatus.

Figure 5:
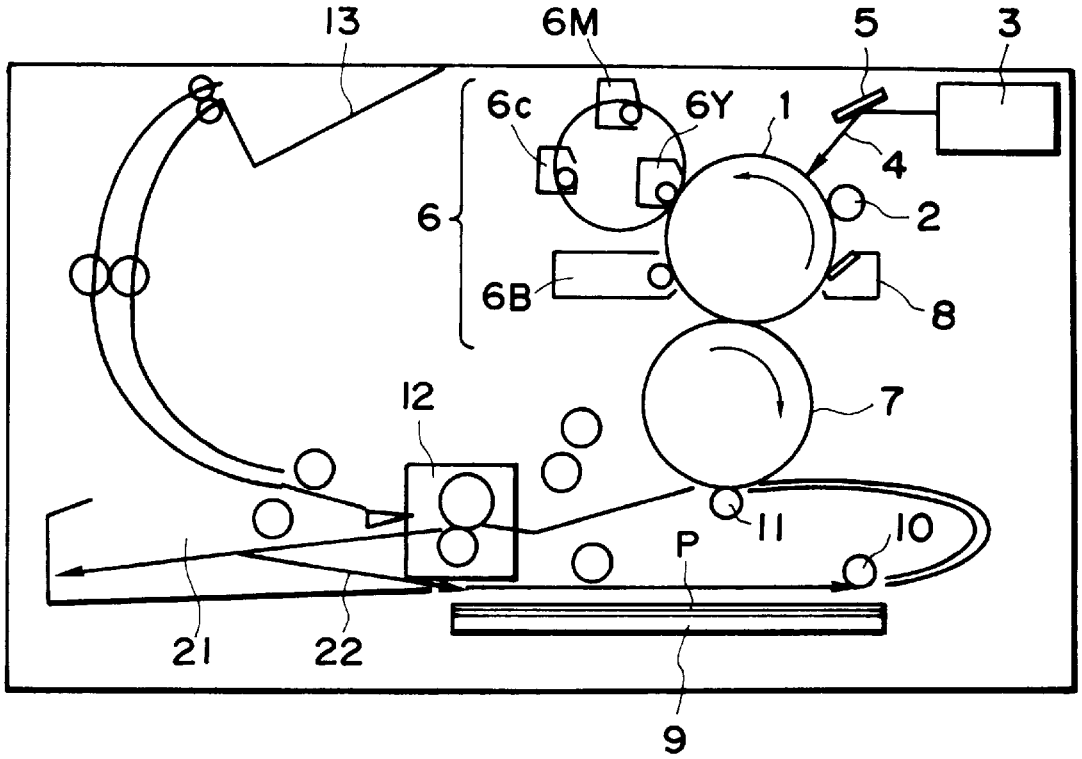
FIG. 5 shows a general arrangement of an image forming apparatus capable of forming images on both sides of a recording material.

FIG. 5 shows an example of an image forming apparatus (duplex image forming apparatus) capable of forming images on both sides, which is a laser scanning type electrophotographic color printer in this example. The full-color toner image formation mechanism and process on the intermediary transfer drum 7 are the same as in above-described FIG. 1, and therefore, the same reference numerals as in FIG. 1 are assigned to the elements having the corresponding functions, and detailed descriptions thereof are omitted for simplicity.

In the duplex mode, the full-color toner image for the first side is formed on the intermediary transfer drum 7, and the toner image is transferred by the transfer roller 11 onto the first surface of the transfer material P as the recording material sheet fed from the sheet feeding cassette 9, and is separated from the transfer drum 7 and fed to the fixing device 12 where the transferred toner image is heated and fixed on the first surface.

The transfer material P having the image on the first surface is discharged from the fixing device 12, and is fed to the reversion tray 21 with the imaged side facing up, and is stayed there temporarily.

The full-color toner image formation is carried out on the second surface, so that image is formed on the intermediary transfer drum 7. The transfer material having been stayed on the reversion tray 21 is fed again to the transfer portion by an upper side sheet feeding roller 10 of the sheet feeding cassette 9 through a path 22 to receive the full-color toner image for the second surface from the intermediary transfer drum 7 onto the second surface thereof.

The transfer material having the toner image on its second surface is fed again to the fixing device 12, so that transferred toner image on the second surface is fixed thereon, and is discharged to the sheet discharge tray 13.

The structures of he fixing device 12 are the same as shown in FIG. 2 to FIG. 4.

During the second side fixing, if the fixing belt 14 and the pressing roller 16 produce the same amounts of heat, the already fixed toner image on the first side would be melted back by the pressing roller 16 with the result of disturbance of the fixed toner image on the first side. Additionally, the pressing roller 16 would be contaminated with the result of the contamination of the back side (first side) of the transfer material. It is desirable that heating value of the fixing belt 14 and the heating value of the pressing roller 16 are made different. For example, by making the heating value of the pressing roller 16 smaller than the heating value of the fixing belt 14, the heat supply can be saved, and the disturbance of the first fixed image, contamination of the pressing roller and the back side contamination of the transfer material can be avoided.

In the magnetic induction heat-fixing of this embodiment, the ratio of the electric power supply to the electroconductive layer 14*a* of the fixing belt 14 and the electric power supply to the electroconductive layer 16*c* of the pressing roller 16 can be changed between when the unfixed image is fixed on the first surface and when the unfixed image is fixed on the second surface by changing the frequency of the current supplied. More particularly, the ratio Is changed such that when the unfixed image is fixed on the first surface, the heat generation of the pressing roller 16 is made relatively greater to make the thermal-expansions of the both sides of the recording material equal to each other to reduce the curling, and when the unfixed image is fixed on the second surface, the heat generation of the pressing roller 16 is reduced so as to prevent the offset of the toner due to melting of the fixed toner on the first surface contacted to the pressing roller 16.

The fixing device of this embodiment has higher responsivity than a conventional heat roller type fixing device, so that temperature adjustment of the pressing roller is relatively easy, and therefore, it is good for the both-side recording. In the conventional belt heating type fixing device, the curling of the recording material is larger so that it is not very suitable to the both-side recording. However, in the case of the magnetic induction heat-fixing, both-side heating is accomplished by a single heating means, and the heat generation adjustment of the pressing member is possible.

Figure 6:
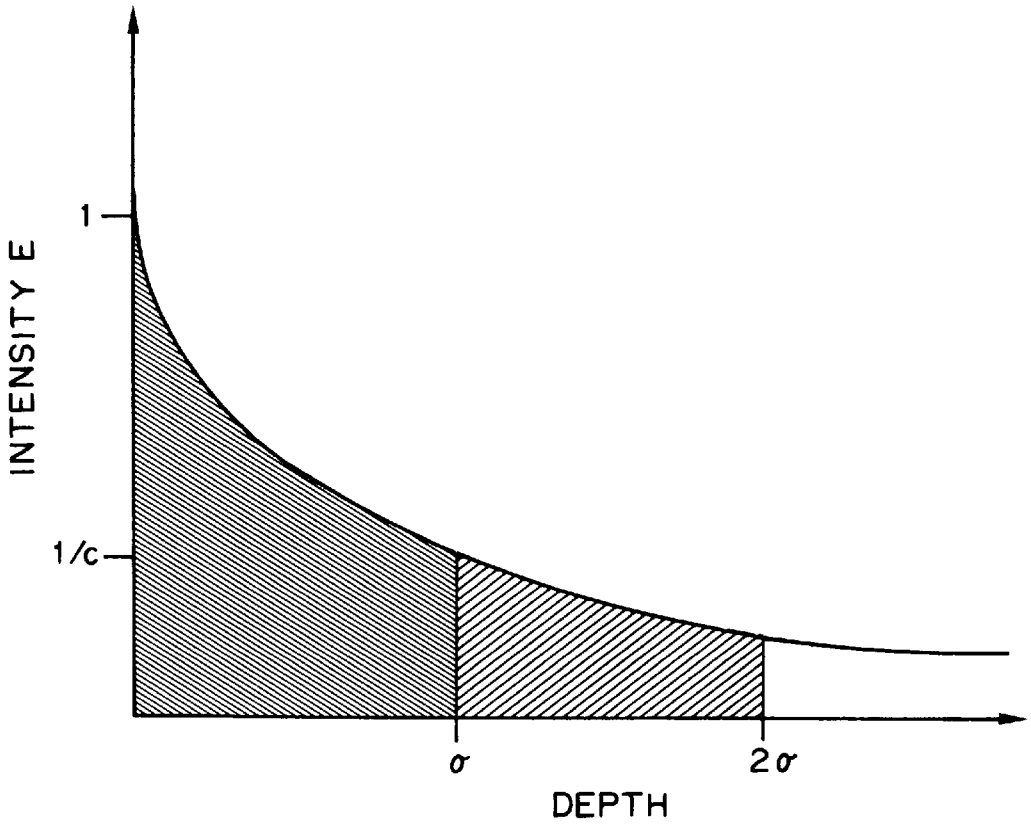
FIG. 6 is an illustration of an absorption factor of an electromagnetic radiation relative to a thickness of an electroconductive layer.

The amounts of the heat generation energy of the electroconductive layers 14*a* , 16*c* of the fixing belt 14 and the pressing roller 16 are determined as shown in FIG. 6. The abscissa in FIG. 6 represents the thickness of the electroconductive layer, and the ordinate represents the strength E of the electromagnetic radiation. As described hereinbefore, the electromagnetic radiation is absorbed by the skin depth a to attenuate to 1/e. The energy if the electromagnetic radiation is proportional to square of intensity, and the energy P absorbed occurring to the depth a from the surface of the excitation coil is:

$$P = \int_0^{\sigma} E^2\,dx = A\int_0^{\sigma} e^{-\frac{2x}{\sigma}}\,dx = -A\frac{\sigma}{2}\left[e^{-\frac{2x}{\sigma}} - 1\right]_0^{\sigma} \quad \text{(A: constant)}$$

As will be understood from the equation, 86.4% of the energy is absorbed by the skin depth σ, and 63.2% is absorbed by the 0.5σ, and 98.2% is absorbed by the depth 2σ.

Accordingly, when the electroconductive layers 14*a* , 16*c* of the fixing belt 14 and the pressing roller 16 are of the same material, and the skin depths relative to a frequency f are 0.5σ, the ratio of the absorbed energy between the fixing belt 14 and the pressing roller 16, is:

63.2:(86.4−63.2)=63.2:23.2

The frequency for the second surface fixing is changed to 4*f*. Then, the σ' for this frequency is one half the σ.

So, the ratio of the absorbed energy of the fixing belt 14 and the pressing roller 16 is:

86.4:(98.2−86.4)=86.4:11.8

Thus, the heat generation of the pressing roller 16 is suppressed when the second surface is heated as compared with the first surface heating.

The experiments of the fixing device 12 of this embodiment will be described.

Experiment Result

When the first surface of the recording material is fixed in the duplex printing mode, both of the fixing belt 14 and the pressing roller 16 are actuated to heat both sides of the recording material. Here, the electroconductive layer 14*a* of the side and the electroconductive layer 16*c* of the pressing roller 16 are both made of Ni. The thicknesses are common to be 50 μm. When the frequency is 100 kHz, the ratio of the heating values of the fixing belt 14 and the pressing roller 16 is approx. 3:1.

When the second surface is to be fixed, the frequency was changed to 400 KHz, the ratio of the amounts of heat generation of the fixing belt 14 and the 400 KHz is 8:1 so that fixing belt 14 to which the second surface of the recording material is contacted generates a larger amount of heat, thus effecting the normal fixing operation without melting the fixed toner on the first surface to which the pressing roller 16 is contacted, so that toner offset can be prevented.

In the experiment, the electroconductive layers 14*a* , 16*c* of the fixing belt 14 and the pressing roller 16 are of the same material and have the same thickness, but the materials and the thicknesses may be different from each other.

Figure 7:
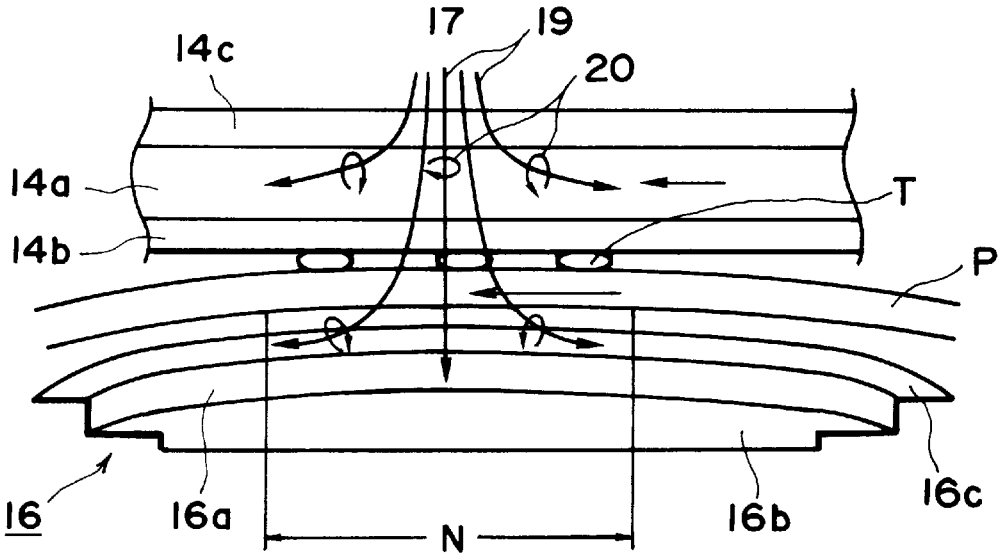
FIG. 7 is an illustration of heating principle in the fixing device.

FIG. 7 shows one of such examples. Normally, the electroconductive layer 16*c* of the pressing roller 16 absorbs the energy not absorbed by the electroconductive layer 14*a* of the fixing belt 14, so that if the material of the electroconductive layer 16*c* is the same as that of the electroconductive layer 14*a* of the fixing belt 14, the heating value of the electroconductive layer 16*c* is smaller. Therefore, the material of the electroconductive layer 16*c* of the pressing roller 16 is preferably such that skin depth thereof is smaller than the electroconductive layer 14*a* of the fixing belt 14.

The total amounts of the total energy supplied to the electroconductive layers 14*a* , 16*c* of the fixing belt 14 and the pressing roller 16, are changed by changing the on- and off-duty of the high frequency current to be supplied to the coil 17b.

The duplex image forming apparatus usable with this embodiment is not limited to the color printer, and may be a monochromatic printer.

The description will be made as to the case wherein continuous print operation is carried out, or the color image formation and monochromatic image formation are alternately carried out.

When the continuous is carried out even in a single side printing mode (simplex mode), the temperature of the pressing roller 16 rises with the result that heat supply of the recording material P from the pressing roller 16 is too large. Therefore, it is preferable that when the temperature of the pressing roller 16 rises, the relation of the heating values of the fixing belt 14 and the pressing roller 16 is gradually changed to prevent excessive rising of the pressing roller 16 temperature.

The temperature of the pressing roller can be deduced on the basis of the time periods of continuous printing operations and the rest periods, and therefore, the frequency is changed to change the ratio of the heating values of the pressing roller 16 and the fixing belt 14 in accordance with the data of the time periods. The temperature of the pressing roller 16 may be directly detected for the control of the heating value ratio.

By doing so, the heat supply amount from the fixing belt 14 to the recording material P and the heat supply amount from the pressing roller 16 to the recording material P can be controlled, by which the curling degree of the recording material is constant, and therefore, the stacking property on the sheet discharge tray 13 is stabilized.

When the color image and the monochromatic image are printed alternately or at random, the both-side heating is carried out by the fixing belt 14 and the pressing roller 16 for the thick toner image such as a color image, and the recording material is heated only at one side by the fixing belt for the monochromatic image is printed on one side. These operation can be performed only by changing the frequency of the current supplied to the coil 17*b*.

Figure 8:
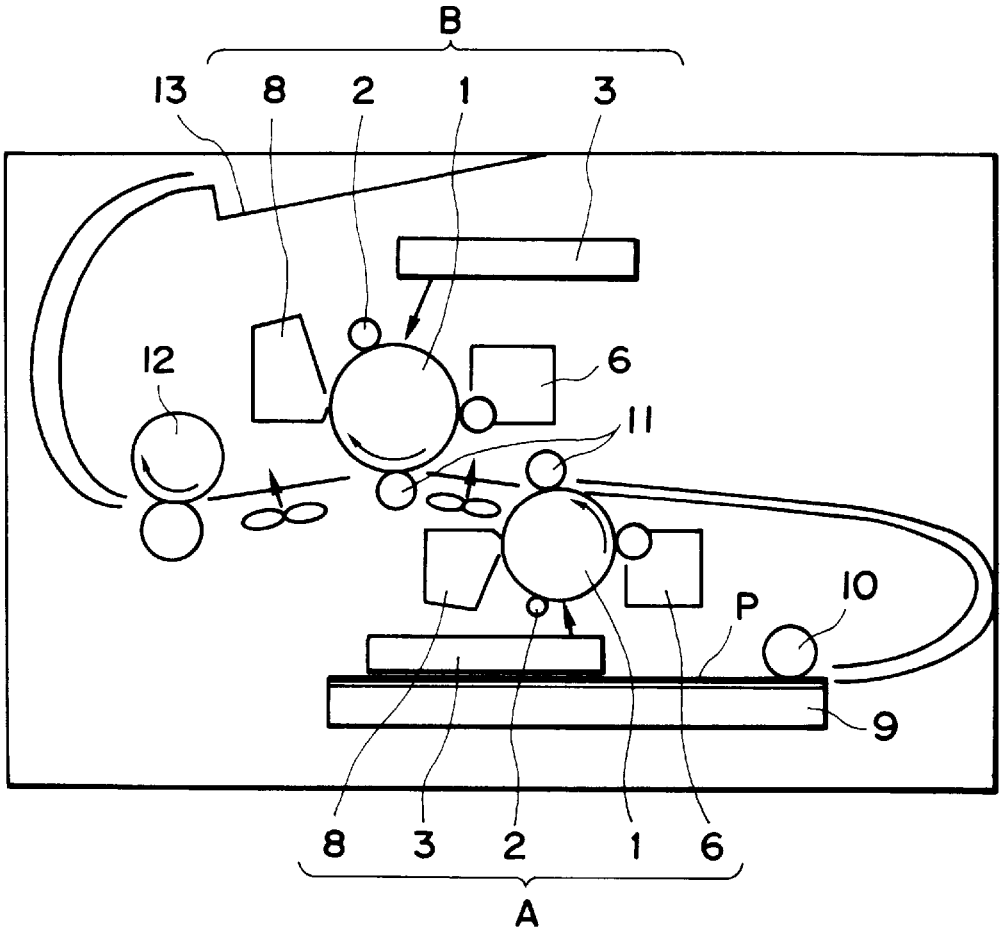
FIG. 8 is a schematic illustration of a printer of a duplex type.

Referring to FIG. 8, the description will be made as to an image recording device capable of a simultaneous duplex printing through one path. The image recording device is applicable to a color printing or monochromatic printing.

In the simultaneous duplex printing, the upper surface and the lower surface receive the toner images simultaneously or with short time delay. The structure is simple and small. Additionally, a quick duplex printing is possible. It this is done using the conventional heat roller type fixing device (upper and lower rollers), the apparatus is bulky, and the responsivity is slow.

Using the magnetic induction heat-fixing, the efficiency is high, and the apparatus structure becomes simple.

In the simultaneous duplex type image recording device, the transfer material P as the recording material fed out of the sheet feeding cassette 9 by the sheet feeding roller 10 is fed to the transfer portion which is between the photosensitive drum 1 of the first image formation mechanism A and the transfer roller 11. The transfer roller 11 supplies the charge of the polarity opposite from the toner to the rear surface of the transfer material, to transfer the toner image from the photosensitive drum 1 onto the first surface of the transfer material.

Then, the transfer material is fed to a transfer portion which is between a photosensitive drum 1 of a second image formation mechanism B and a transfer roller 11, where a toner image is fed from the photosensitive drum 1 to the second surface of the transfer material.

The transfer material thus receives the toner images on its first surface and the second surface sequentially through the transfer portions of the image formation mechanisms A, B, and is introduced into the fixing device 12, where the toner images are heated and fixed on the first surface and the second surface. The transfer material is then discharged onto the sheet discharge tray 13.

The structure of the fixing device 12 per se is the same as in FIG. 2 to FIG. 4. In the fixing device 12, both of the temperatures of the fixing belt 14 and the pressing roller 16 are raised to the fixing temperature, or if necessary, only the temperature of the fixing belt 14 is raised so as to fix the unfixed toner image or images. In the foregoing, the description has been made as to the image heat-fixing device, but the heating apparatus of the present invention is not limited to such an apparatus, and is applicable to an apparatus which heats the recording material to improve the surface property (glossiness), to a temporary fixing apparatus, an apparatus which heats a material to be heated in the form of a sheet, or the like.

In the foregoing a printer has been taken as the image forming apparatus. However, it is applicable to a copying machine, a facsimile machine or the like.

While the invention has been described with reference to the structures disclosed herein, it is not confined to the details set forth and this application is intended to cover such modifications or changes as may come within the purposes of the improvements or the scope of the following claims.

What is claimed is:

1. An image heating apparatus comprising:

a film;

magnetic flux generating means for generating a magnetic flux;

wherein the magnetic flux generated by said magnetic flux generating means generates an eddy current which in turn generates heat in said film to heat an image on a recording material; and wherein said film includes an electroconductive layer, an elastic layer on said electroconductive layer and wire rods of a ferromagnetic material dispersed in said elastic layer, and wherein said electroconductive layer and said elastic layer are caused to generate heat by said magnetic flux generating means.

2. An apparatus according to claim 1, wherein the wire rods are of nickel, iron or stainless steel.

3. An apparatus according to claim 1, wherein said wire rods constitute a net.

4. An apparatus according to claim 1, further comprising a pressing member contacted to said film which cooperates with said film to form a nip therebetween, wherein the recording material carrying the unfixed toner image is fed through the nip, by which the unfixed toner image is fixed on the recording material.

5. An apparatus according to claim 4, wherein the unfixed toner image comprises different color toners, which are mixed into a color image after being fixed.

6. An image heating apparatus comprising:

a film;

magnetic flux generating means for generating a magnetic flux;

wherein the magnetic flux generated by said magnetic flux generating means generates an eddy current which in turn generates heat in said film to heat an image on a recording material; and wherein said film includes an electroconductive layer, an elastic layer on said electroconductive layer and fibers of a ferromagnetic material dispersed in said elastic layer, and wherein said electroconductive layer and said elastic layer are caused to generate heat by said magnetic flux generating means.

7. An apparatus according to claim 6, wherein the fibers are steel wool or metal steel wool plated with a ferromagnetic material.

8. An apparatus according to claim 6, wherein said fibers are carbon fibers, artificial fibers or heat resistive fibers plated with a ferromagnetic material.

9. An apparatus according to claim 6, further comprising a pressing member contacted to said film which cooperates with said film to form a nip therebetween, wherein the recording material carrying the unfixed toner image is fed through the nip, by which the unfixed toner image is fixed on the recording material.

10. An apparatus according to claim 9, wherein the unfixed toner image comprises different color toners, which are mixed into a color image after being fixed.

11. An apparatus according to claim 6 wherein said fibers constitute a mesh.

12. An image heating apparatus comprising:

a film;

magnetic flux generating means for generating a magnetic flux;

wherein the magnetic flux generated by said magnetic flux generating means generates an eddy current which in turn generates heat in said film to heat an image on a recording material; and wherein said film has an electroconductive layer and an elastic layer on said electroconductive layer, and ferromagnetic material is dispersed in said elastic layer.

13. An apparatus according to claim 12, wherein said ferromagnetic material is in the form of wire rods.

14. An apparatus according to claim 13, wherein the wire rods are of nickel, iron or stainless steel.

15. An apparatus according to claim 12, wherein said ferromagnetic material is fibers.

16. An apparatus according to claim 15, wherein the fibers are steel wool or metal steel wool plated with a ferromagnetic material.

17. An apparatus according to claim 15, wherein said fibers are carbon fibers, artificial fibers or heat resistive fibers plated with a ferromagnetic material.

18. An image heating film comprising:

an electroconductive layer;

an elastic layer; and a ferromagnetic material dispersed in said elastic layer.

19. An apparatus according to claim 18, wherein said ferromagnetic material is in the form of wire rods.

20. An apparatus according to claim 19, wherein the wire rods are of nickel, iron or stainless steel.

21. An apparatus according to claim 18, wherein said ferromagnetic material is fibers.

22. An apparatus according to claim 21, wherein the fibers are steel wool or metal steel wool plated with a ferromagnetic material.

23. An apparatus according to claim 21, wherein said fibers are carbon fibers, artificial fibers or heat resistive fibers plated with a ferromagnetic material.

24. A film according to claim 18, wherein said film is an endless film, and said elastic layer is provided outside said electroconductive layer.

25. A film according to claim 18, wherein said film is a film for induction heating.

* * * * *

UNITED STATES PATENT AND TRADEMARK OFFICE

CERTIFICATE OF CORRECTION

PATENT NO. : 6,070,046
DATED : May 30, 2000
INVENTOR(S) : Ryuichirou Maeyama

It is certified that error appears in the above-identified patent and that said Letters Patent is hereby corrected as shown below:

Column 3:
Line 26, "comprises" should read -- comprises a --.

Column 5:
Line 60, "if is" should read -- if it is --.

Column 6:
Line 16, "that" should read -- that the --;
Line 32, "that" should read -- that the --; and
Line 35, "that" should read -- that the --.

Column 8:
Line 37, "of he" should read -- of the --; and
Line 46, "that" should read -- that the --.

Column 9:
Line 24, "a" should read -- σ --.

Column 10:
Line 31, "continuous" should read -- continuous print operation --.

Column 11:
Line 2, "It" should read -- if --.

UNITED STATES PATENT AND TRADEMARK OFFICE

CERTIFICATE OF CORRECTION

PATENT NO. : 6,070,046
DATED : May 30, 2000
INVENTOR(S) : Ryuichirou Maeyama

It is certified that error appears in the above-identified patent and that said Letters Patent is hereby corrected as shown below:

Column 13:
Line 11, "An apparatus" should read -- A film --; and
Line 13, "An apparatus" should read -- A film --.

Column 14:
Line 1, "An apparatus" should read -- A film --;
Line 3, "An apparatus" should read -- A film --; and
Line 6, "An apparatus" should read -- A film --.

Signed and Sealed this

Twenty-fifth Day of September, 2001

*Attest:*

Nicholas P. Godici

NICHOLAS P. GODICI
*Acting Director of the United States Patent and Trademark Office*

*Attesting Officer*